US008789503B2

(12) United States Patent
Kobayashi et al.

(10) Patent No.: US 8,789,503 B2
(45) Date of Patent: Jul. 29, 2014

(54) VALVE TIMING CONTROL APPARATUS

(75) Inventors: Masaki Kobayashi, Okazaki (JP); Yoshihiro Kawai, Obu (JP)

(73) Assignee: Aisin Seiki Kabushiki Kaisha, Kariya-Shi (JP)

( * ) Notice: Subject to any disclaimer, the term of this patent is extended or adjusted under 35 U.S.C. 154(b) by 259 days.

(21) Appl. No.: 13/120,084

(22) PCT Filed: Feb. 12, 2010

(86) PCT No.: PCT/JP2010/052076

§ 371 (c)(1),
(2), (4) Date: Mar. 21, 2011

(87) PCT Pub. No.: WO2010/109971

PCT Pub. Date: Sep. 30, 2010

(65) Prior Publication Data

US 2011/0168114 A1 Jul. 14, 2011

(30) Foreign Application Priority Data

Mar. 25, 2009 (JP) ..... 2009-074112
Aug. 31, 2009 (JP) ..... 2009-200215

(51) Int. Cl.
*F01L 1/34* (2006.01)

(52) U.S. Cl.
USPC ..... 123/90.17; 464/160

(58) Field of Classification Search
USPC ..... 123/90.17, 90.15; 464/160, 161
See application file for complete search history.

(56) References Cited

U.S. PATENT DOCUMENTS 5,823,152 A 10/1998 Ushida
5,836,277 A 11/1998 Kira et al.

(Continued)

FOREIGN PATENT DOCUMENTS

CN 1821554 A 8/2006
DE 10 2004 043 328 A 4/2006

(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued by the International Bureau on Oct. 27, 2011 in corresponding International Application No. PCT/JP2010/052076.

(Continued)

*Primary Examiner* — Kenneth Bomberg
*Assistant Examiner* — Wesley Harris
(74) *Attorney, Agent, or Firm* — Buchanan Ingersoll & Rooney P.C.

(57) ABSTRACT

A valve timing control apparatus includes a phase holding mechanism for holding relative phase between an inner peripheral member and an outer peripheral member to a predetermined intermediate phase between a most advanced angle phase and a most retarded angle phase, a fluid feeding device for feeding fluid to an advanced angle chamber or a retarded angle chamber through a first fluid passageway or a second fluid passageway, and a fluid control valve for switching over the passage for the fluid discharged from the fluid feeding device to either the first fluid passageway or the second fluid passageway and controlling the feeding amount of the fluid. The phase holding mechanism is configured to have its holding state for holding the relative phase released by a fluid pressure of the first fluid passageway or the second fluid passageway to whichever the fluid control valve starts the feeding of the fluid. After releasing of the holding state of the relative phase, this releasing state is maintained by a fluid pressure applied thereto from at least one of the first fluid passageway and the second fluid passageway.

6 Claims, 4 Drawing Sheets

(56) References Cited

U.S. PATENT DOCUMENTS

| | | | |
|---|---|---|---|
| 6,035,819 | A | 3/2000 | Nakayoshi et al. |
| 6,053,139 | A | 4/2000 | Eguchi et al. |
| 2002/0040697 | A1 | 4/2002 | Sugiura et al. |
| 2002/0078913 | A1 | 6/2002 | Fukuhara et al. |
| 2002/0139332 | A1 | 10/2002 | Takenaka |
| 2002/0152978 | A1 | 10/2002 | Todo |
| 2005/0051122 | A1 | 3/2005 | Hirowatari et al. |
| 2005/0205032 | A1 | 9/2005 | Lehmann et al. |
| 2005/0284432 | A1 | 12/2005 | Tsukada |
| 2006/0180107 | A1 | 8/2006 | Sato et al. |
| 2010/0050966 | A1 | 3/2010 | Ozawa et al. |
| 2011/0168114 | A1 | 7/2011 | Kobayashi et al. |
| 2012/0000437 | A1 | 1/2012 | Ozawa et al. |

FOREIGN PATENT DOCUMENTS

| | | | |
|---|---|---|---|
| JP | 10-184320 | | 7/1998 |
| JP | 11-132015 | A | 5/1999 |
| JP | 11-210424 | A | 8/1999 |
| JP | 11-311107 | A | 11/1999 |
| JP | 2000-2104 | A | 1/2000 |
| JP | 2002-357105 | A | 12/2002 |
| JP | 2003-286813 | A | 10/2003 |
| JP | 3918971 | B2 | 5/2007 |

OTHER PUBLICATIONS

Chinese Office Action (Notification of the First Office Action) dated Oct. 10, 2012, issued by the State Intellectual Property Office of P.R.C. in corresponding Chinese Patent Application No. 201080002689.1 and English translation. (9 pages).

International Search Report (PCT/ISA/210) issued on May 18, 2010, by Japanese Patent Office as the International Searching Authority for International Application No. PCT/JP2010/052076.

Written Opinion (PCT/ISA/237) issued on May 18, 2010, by Japanese Patent Office as the International Searching Authority for International Application No. PCT/JP2010/052076.

European Search Report issued by European Patent Office on Apr. 10, 2013 in European Application No. 10 75 5772 (9 pages).

Chinese Official Action issued by Chinese Patent Office on Apr. 25, 2013 in Chinese Application No. 201080002689.1 (16 pages).

VALVE TIMING CONTROL APPARATUS

TECHNICAL FIELD

The present invention relates to a valve timing control apparatus for controlling opening and closing timings of an intake valve and an exhaust valve of an internal combustion engine.

BACKGROUND ART

In recent years, a valve timing control apparatus configured to allow varying of opening and closing timings of an intake valve and an exhaust valve depending on an operational condition of an internal combustion engine is often mounted to one terminal end of a cam shaft.

According to one known technique relating to one type of valve timing control apparatus of the above-noted kind, in a valve timing control apparatus configured to transmit an engine rotational drive force from a crank shaft to the cam shaft via a power transmitting means such as a timing chain, when no pressure oil is being fed to a hydraulic chamber from a pump at the time of startup of the engine, a leading end of a stopper piston (lock pin) is brought into engagement into a stopper hole (receiving hole), thereby to lock a shoe housing (outer rotor) and a vane rotor (inner rotor) relative to each other for their rotation in unison, as a result of which generation of hitting noise between the housing and the vane component is avoided (see e.g. Patent Document 1).

According to another known technique relevant to the above, an arrangement is provided such that at the time of startup of an internal combustion engine, upon establishment of synchronization or positional registry between a receiving hole and a retracting hole, an amount of fluid is fed into an advanced angle chamber through a first fluid passageway or into a retarded angle chamber through a second fluid passageway Further, at the time of the synchronization of positions between the receiving hole and the retracting hole, a third fluid passageway is communicated to the first fluid passageway or the second fluid passageway; whereas at the time of non-synchronization therebetween, the communication between the third fluid passageway and the first or second fluid passageway is blocked. For use in this construction, there is disclosed a technique for restricting generation of noise due to "fluttering" of the lock pin within the retracting hole in association with pressure fluctuation, thus restricting frictional wear of the lock pin (see e.g. Patent Document 2).

According to still another known technique relevant to the above, a phase holding mechanism (a lock pin, a spring) is provided for holding a rotational shaft (a cam shaft and an inner rotor) and a rotation transmitting member (an outer rotor) at a predetermined relative phase when the internal combustion engine is under a valve opening/closing phase when the engine can be started, at the time of an intermediate relative phase between the most advanced angle phase wherein the volume of the retarded angle chamber is rendered minimum by the vane and the most retarded angle phase wherein the volume of the advanced angle chamber is rendered minimum by the vane. Further, a relative rotation restricting means (an engaging pin, a spring, an engaging groove) is provided for restricting relative rotation of the rotational shaft from the predetermined phase relative to the rotation transmitting member toward the retarded angle side, at the time of stopping and starting of the internal combustion engine. With these arrangements, generation of hitting noise of the vane at the time of startup of the internal combustion engine and engine startup failure are prevented reliably and at the same time the arrangements provide an increased variable control range (see e.g. Patent Document 3).

PRIOR ART DOCUMENT

Patent Documents

Patent Document 1: Japanese Patent Application "Kokai" No. 2000-2104

Patent Document 2: Japanese Patent Application "Kokai" No. 11-132015

Patent Document 3: Japanese Patent Application "Kokai" No. 11-311107

SUMMARY OF THE INVENTION

Object to be Achieved by Invention

However, if the construction disclosed in Patent Document 1 is applied to a valve timing control apparatus configured to provide locking at a predetermined angle between the most advanced angle phase and the most retarded angle phase, simultaneously with feeding of the work oil to the valve timing control apparatus at the time of startup of the internal combustion engine, the advanced angle oil pressure or the retarded angle oil pressure is applied to the lock pin, thus releasing this lock pin. Therefore, when it is desired to hold at an intermediate phase, the lock pin can be released inadvertently.

If the construction disclosed in Patent Document 2 is applied to the valve timing control apparatus configured to provide locking at a predetermined angle between the most advanced angle phase and the most retarded angle phase, the locking will be released by application of one-sided (one-direction) oil pressure of either the advanced angle pressure or the retarded angle pressure. Hence, in the course of movement of the lock pin across the receiving hole during the operation from an advanced angle phase to a retarded angle phase or vice versa, the lock pin may erroneously get caught within the receiving hole.

Also, in the case of the construction disclosed in Patent Document 3, since a releasing oil passageway for the lock pin used for locking at an intermediate phase is provided as a circuit separate from those for the advanced angle pressure and the retarded angle pressure, an oil pressure control valve or an oil pressure switch valve will be needed separately for releasing the lock pin, in addition to the oil pressure control valve for the valve timing control apparatus. Hence, the construction can lead to deterioration in the system adaptability or compatibility as well as to disadvantageous increase in the costs and weight.

Then, in a valve timing control apparatus, the object of the present invention is to provide an improved valve timing control apparatus capable of providing reliable locking at a predetermined intermediate phase with a simple arrangement, without inadvertent displacement or operation of the lock pin by an advanced angle oil pressure or a retarded angle oil pressure, at the time of startup of the internal combustion engine.

Means for Achieving the Object

According to the first technical solution provided by the present invention for achieving the above object, A valve timing control apparatus comprises:

an inner peripheral member rotatable in unison with a valve opening/closing cam shaft rotatably assembled to a cylinder head of an internal combustion engine;

a vane rotatable in unison with said inner peripheral member;

an outer peripheral member rotatable relative to said inner peripheral member;

a plurality of fluid pressure chambers disposed between said inner peripheral member and said outer peripheral member and divided by said vane into an advanced angle chamber and a retarded angle chamber;

a first fluid passageway for feeding/discharging fluid to/from said advanced angle chamber;

a second fluid passageway for feeding/discharging fluid to/from said retarded angle chamber;

a phase holding mechanism for holding relative phase between said inner peripheral member and said outer peripheral member to a predetermined phase between a most advanced angle phase and a most retarded angle phase;

a fluid feeding device for feeding fluid to said advanced angle chamber or said retarded angle chamber through said first fluid passageway or said second fluid passageway; and a fluid control valve for switching over the passage for the fluid discharged from said fluid feeding device to either said first fluid passageway or said second fluid passageway and controlling the feeding amount of said fluid;

wherein said phase holding mechanism is configured to have its holding state for holding said relative phase released by a fluid pressure of one of said first fluid passageway and said second fluid passageway to whichever said fluid control valve starts the feeding of the fluid and configured also to have its releasing state maintained by a fluid pressure applied thereto from at least one of said first fluid passageway and said second fluid passageway after releasing of said holding state of said relative phase.

According to the second technical solution provided by the present invention, in the above first technical solution, said phase holding mechanism includes a restricting member for restricting said relative phase, an accommodating hole provided in said inner peripheral member for slidably accommodating said restricting member, a receiving hole provided in said outer peripheral member for receiving the leading end of said restricting member and an urging member for urging said restricting member in the direction to said outer peripheral member;

said restricting member includes a first pressure receiving face for receiving either one of the fluid pressure of said advanced angle chamber and the fluid pressure of said retarded angle chamber and a second pressure receiving face for receiving the other of the fluid pressure of said advanced angle chamber and the fluid pressure of said retarded angle chamber; and in response to switchover of the fluid feeding from said fluid feeding device from either one of said advanced angle chamber and said retarded angle chamber to the other of said advanced angle chamber and said retarded angle chamber, the other of the fluid pressure of said advanced angle chamber and the fluid pressure of said retarded angle chamber is applied to said second pressure receiving face, thereby to release the holding state of said phase holding mechanism.

According to the third technical solution provided by the present invention, in the above second technical solution, after releasing of said holding state of said phase holding mechanism, in response to at least one of the application to said first pressure receiving face of the fluid pressure of one of the fluid pressure of said advanced angle chamber and the fluid pressure of said retarded angle chamber and the application to said second pressure receiving face of the fluid pressure of the other of the fluid pressure of said advanced angle chamber and the fluid pressure of said retarded angle chamber, the releasing of said holding state of said phase holding mechanism is maintained.

According to the fourth technical solution provided by the present invention, in the above first technical solution, said phase holding mechanism includes a restricting member for restricting said relative phase, an accommodating hole provided in said inner peripheral member for slidably accommodating said restricting member, a receiving hole provided in said outer peripheral member for receiving the leading end of said restricting member and an urging member for urging said restricting member in the direction to said outer peripheral member;

said restricting member includes a first pressure receiving face for receiving either one of the fluid pressure of said advanced angle chamber and the fluid pressure of said retarded angle chamber and a second pressure receiving face for receiving the other of the fluid pressure of said advanced angle chamber and the fluid pressure of said retarded angle chamber; and said first pressure receiving face and said second pressure receiving face are configured to have different pressure receiving areas from each other.

According to the fifth technical solution provided by the present invention, in the above fourth technical solution, said fluid feeding device is rotatably driven by receiving a rotational force of a crank shaft of the internal combustion engine; and a pressing force for pressing said restricting member against the urging force of said urging member which pressing force results, during an idling operation of the internal combustion engine, from application of the fluid fed from said fluid feeding device to one of whichever of said first pressure receiving face and said second pressure receiving face having the smaller pressure receiving area than the other is smaller than the urging force of said urging member.

According to the sixth technical solution provided by the present invention, in the above fifth technical solution, a pressing force for pressing said restricting member against the urging force of said urging member which pressing force results, during an idling operation of the internal combustion engine, from application of the fluid fed from said fluid feeding device to one of whichever of said first pressure receiving face and said second pressure receiving face having the larger pressure receiving area than the other is larger than the urging force of said urging member.

According to the seventh technical solution provided by the present invention, in any one of the above fourth to sixth technical solutions, in response to switchover of the fluid feeding from said fluid feeding device from either one of said advanced angle chamber and said retarded angle chamber to the other of said advanced angle chamber and said retarded angle chamber, the other of the fluid pressure of said advanced angle chamber and the fluid pressure of said retarded angle chamber is applied to said second pressure receiving face, thereby to release the holding state of said phase holding mechanism.

According to the eighth technical solution provided by the present invention, in any one of the above seventh technical solution, after releasing of said holding state of said phase holding mechanism, in response to at least one of the application to said first pressure receiving face of the fluid pressure of one of the fluid pressure of said advanced angle chamber and the fluid pressure of said retarded angle chamber and the application to said second pressure receiving face of the fluid pressure of the other of the fluid pressure of said advanced angle chamber and the fluid pressure of said retarded angle chamber, the releasing of said holding state of said phase holding mechanism is maintained.

Effects of the Invention

According to the present invention, the phase holding mechanism is configured to have its holding state for holding the relative phase released only by the fluid pressure of either one of the first fluid passageway and the second fluid passageway to whichever the fluid control valve starts feeding of fluid. Therefore, there occurs no erroneous and inadvertent operation of the lock pin by the advanced angle fluid (oil) pressure of the retarded angle fluid (oil) pressure fed from the fluid feeding device that starts its operation simultaneously with startup of the internal combustion engine. Hence, a predetermined intermediate phase can be held in a reliable manner by such simple arrangement.

Further, after releasing of the holding state for holding the predetermined phase, the releasing state is maintained by a fluid pressure applied thereto from at least one of the first fluid passageway and the second fluid passageway. Hence, erroneous engagement of the lock pin into the receiving hole in the course of its movement across this receiving hole during the operation from an advanced angle phase to a retarded angle phase or vice versa can be restricted.

And, with the further construction wherein phase holding mechanism includes a restricting member for restricting said relative phase, an accommodating hole provided in said inner peripheral member for slidably accommodating said restricting member, a receiving hole provided in said outer peripheral member for receiving the leading end of said restricting member and an urging member for urging said restricting member in the direction to said outer peripheral member; and said restricting member includes a first pressure receiving face for receiving either one of the fluid pressure of said advanced angle chamber and the fluid pressure of said retarded angle chamber and a second pressure receiving face for receiving the other of the fluid pressure of said advanced angle chamber and the fluid pressure of said retarded angle chamber; and in response to switchover of the fluid feeding from said fluid feeding device from either one of said advanced angle chamber and said retarded angle chamber to the other of said advanced angle chamber and said retarded angle chamber, the other of the fluid pressure of said advanced angle chamber and the fluid pressure of said retarded angle chamber is applied to said second pressure receiving face, thereby to release the holding state of said phase holding mechanism, there is no need for separately providing a fluid control valve or a pressure switching valve for releasing the lock pin. Hence, it is possible to restrict deterioration in the system adaptability or compatibility as well as disadvantageous increase in the costs and weight.

Further, with the still further construction wherein after releasing of said holding state of said phase holding mechanism, in response to at least one of the application to said first pressure receiving face of the fluid pressure of one of the fluid pressure of said advanced angle chamber and the fluid pressure of said retarded angle chamber and the application to said second pressure receiving face of the fluid pressure of the other of the fluid pressure of said advanced angle chamber and the fluid pressure of said retarded angle chamber, this releasing of said holding state of said phase holding mechanism is maintained, the releasing state of the phase maintenance can be maintained by a simple construction.

With the still further construction wherein said first pressure receiving face and said second pressure receiving face are configured to have different pressure receiving areas from each other, in case for instance, the restriction between the inner peripheral member and the outer peripheral member by the restricting member is to be released by fluid pressure to whichever of the first pressure receiving face and the second pressure receiving face having the larger pressure receiving area than the other, it is possible to inhibit releasing of the restriction by the restricting member unless the fluid pressure exceeds a predetermined fluid pressure. Further, also in case the restriction between the inner peripheral member and the outer peripheral member by the restricting member is desired while maintaining the application of the fluid pressure to whichever of the first pressure receiving face and the second pressure receiving face having the larger pressure receiving area than the other, this restriction by the restricting member is made possible with a fluid pressure below a predetermined pressure. In this way, the restriction or releasing of the restriction by the restricting member can be set, independently of communication between the first pressure receiving face or the second pressure receiving face and the advanced angle chamber or the retarded angle chamber.

With the still further construction wherein a pressing force for pressing said restricting member against the urging force of said urging member which pressing force results, during an idling operation of the internal combustion engine, from application of the fluid fed from said fluid feeding device to one of whichever of said first pressure receiving face and said second pressure receiving face having the smaller pressure receiving area than the other is smaller than the urging force of said urging member, restriction of the inner peripheral member and the outer peripheral member by the restricting member at the time of idling operation of the internal combustion engine is made possible. Therefore, in comparison with an arrangement of effecting the restriction of the inner peripheral member and the outer peripheral member by the restricting member after stopping of the internal combustion engine, even if a failure occurs inadvertently to disable restricting by the restricting member, the restricting by the restricting member is still made possible in more reliable manner.

With the still further construction wherein a pressing force for pressing said restricting member against the urging force of said urging member which pressing force results, during an idling operation of the internal combustion engine, from application of the fluid fed from said fluid feeding device to one of whichever of said first pressure receiving face and said second pressure receiving face having the larger pressure receiving area than the other is larger than the urging force of said urging member, even when the pressure receiving area of either the first pressure receiving face or the second pressure receiving face having the smaller pressure receiving area is set so as to avoid the above-described failure condition of the restriction by the restricting member being disabled, it is possible to avoid disablement of releasing of the restriction by the restricting member.

MODES OF EMBODYING INVENTION

Embodiments of the present invention will now be described with reference to the accompanying drawings. The present invention is provided for controlling valve opening and closing timings of at least one of an intake side and an exhaust side of an internal combustion engine. However, in the following discussion, there will be mainly explained a case where the invention is applied to the intake side.

Figure 1:
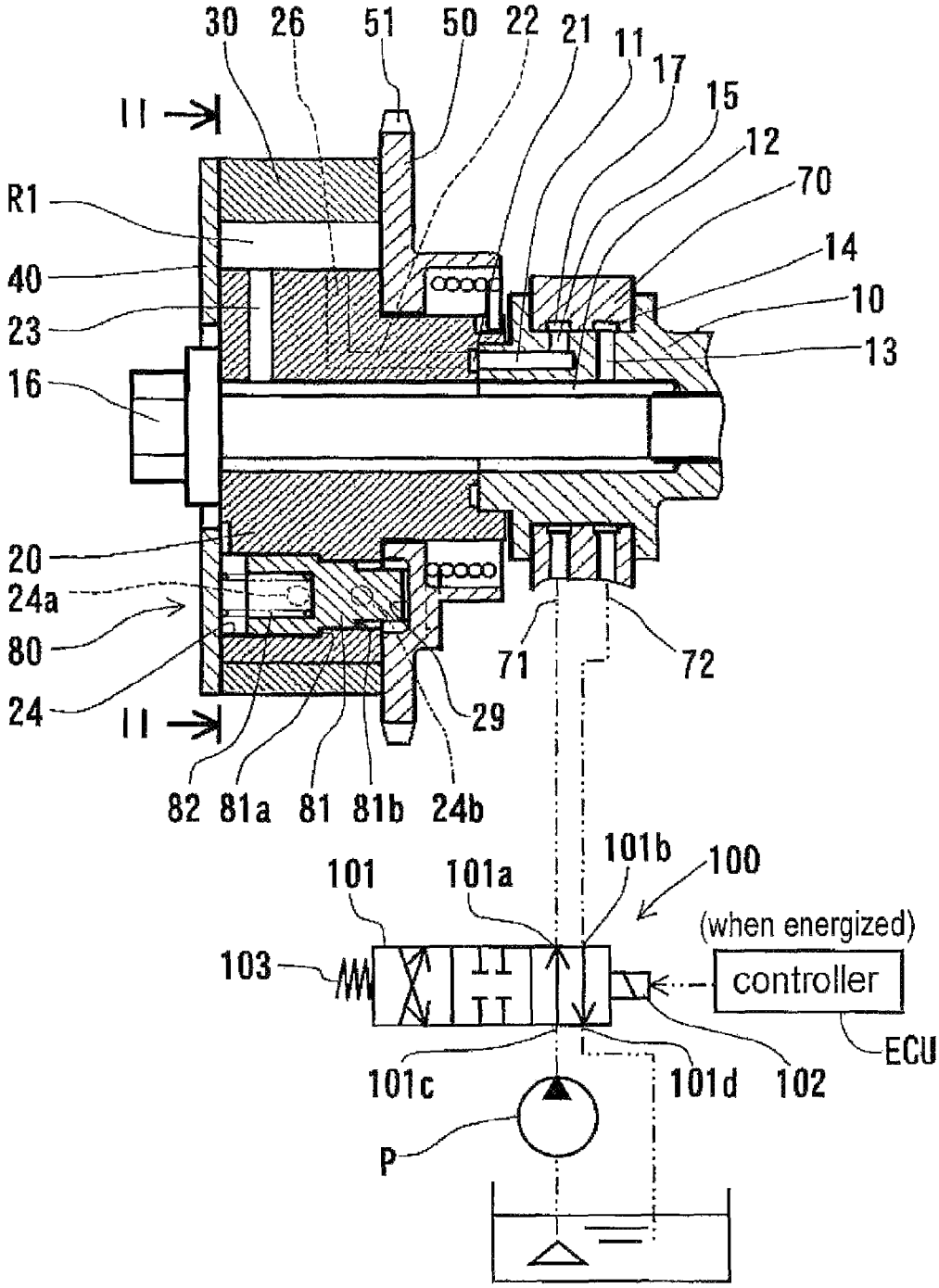
FIG. 1 is a vertical section showing one embodiment of a valve timing control apparatus according to the present invention (corresponding to a section taken along I-I in FIG. 2)
Figure 2:
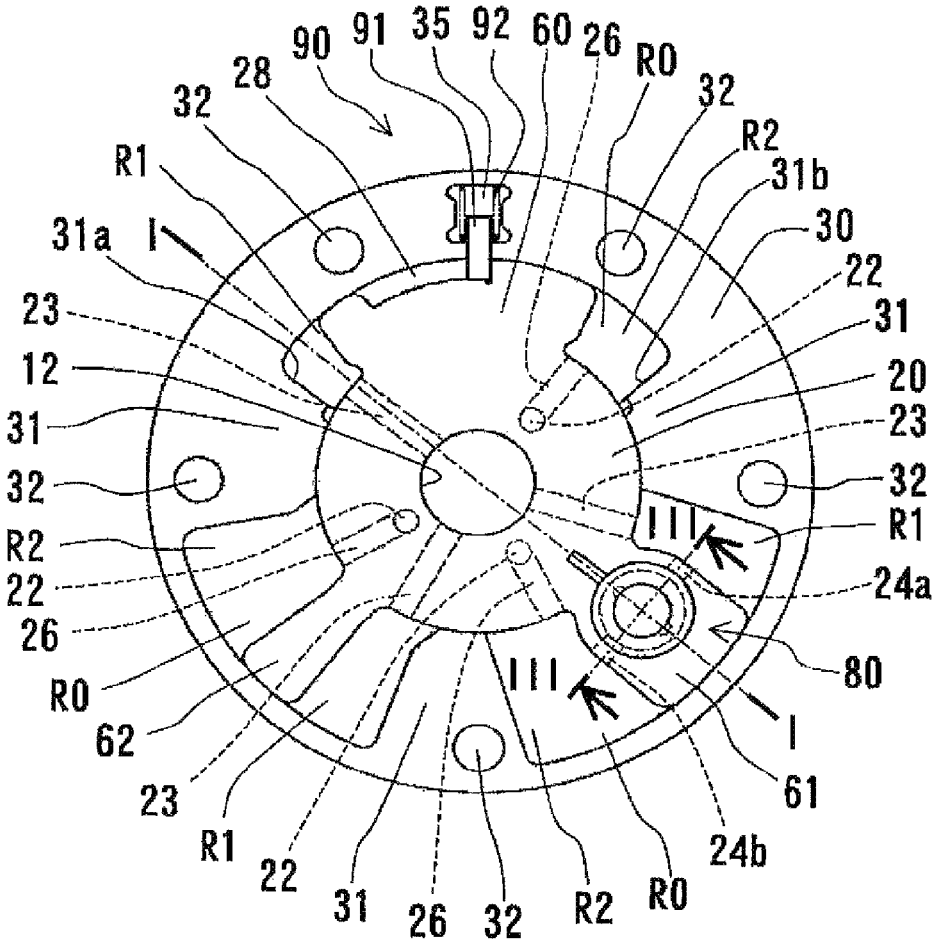
FIG. 2 is a view taken along II-II in FIG. 1, showing a condition wherein a phase holding mechanism is holding a predetermined intermediate relative phase between a rotational shaft and a rotation transmitting member.

In FIG. 1 and FIG. 2, the valve timing control apparatus comprises a valve opening/closing rotational shaft consisting of a cam shaft 10 rotatably supported to a cylinder head 70 of the internal combustion engine and an inner rotor 20 integrally assembled to the leading end portion (the left end in FIG. 1) of the cam shaft 10, a rotation transmitting member consisting of an outer rotor 30 mounted outwardly on the cam shaft 10 and the inner rotor 20 to be rotatable relative thereto over a predetermined range, a front plate 40, a rear plate 50 and a timing sprocket 51 provided integrally on the outer periphery of the rear plate 50, three vanes 60, 61, 62 formed integrally with the inner rotor 20, a lock mechanism ("a phase holding mechanism") 80 assembled to the inner rotor 20, and a relative rotation restricting mechanism 90 including e.g. a restricting key 91 assembled with the outer rotor 30. Incidentally, the timing sprocket 51 is configured, as well-known, to receive a rotational force in the clockwise direction in FIG. 2 via a crank sprocket and a timing chain from an unillustrated crank shaft.

The cam shaft 10 includes a well-known cam for opening/closing an unillustrated intake valve and also includes inside thereof a retarded angle passageway 11 and an advanced angle passageway 12 extending along the axis direction of the cam shaft 10. The advanced angle passageway 12 is formed within an attaching hole for an attaching bolt 16 provided in the cam shaft 10 and connected to a connection port 101*b* of a control valve 100 through a radial passageway 13 defined in the cam shaft 10, an annular groove 14 and a connecting passageway 72 defined in the cylinder head 70. The retarded angle passageway 11 is connected to the connection port 101*a* of the control valve 100 through the passageway 15 provided in the cam shaft 10 and the annular groove 17 and the connecting passageway 71 that are provided in the cylinder head 70.

The control valve 100 is capable of moving, in response to energization of a solenoid 102, a spool 101 inserted movably along the axial direction inside a housing of this control valve 100 to the left direction in FIG. 1 against a spring 103. At the time of power energization, a supply port 101*c* connected to an oil pump P driven by the internal combustion engine is communicated with the connection port 101*a*, and also a connection port 101*b* is communicated to an exhaust port 101*d*. At the time of no power energization, the supply port 101*c* is communicated to the connection port 101*b* and also the connection port 101*a* is communicated to the exhaust port 101*d*. And, at the time of energization of the solenoid 102 of the control valve 100, work oil is fed to the retarded angle passageway 11; whereas, at the time of no energization of the solenoid 102, work oil is fed to the advanced angle passageway 12. And, energization of the solenoid 102 is duty-controlled by a controller ECU.

The inner rotor 20 is integrally fixed to the cam shaft 10 by an attaching bolt 16 and integrally forms the three vanes 60, 61, 62. Further, one vane 61 of the inner rotor 20 defines, along the axial direction of this vane 61, a retracting hole 24 configured to receive a lock pin 81 and a spring 82 of the lock mechanism 80 for holding a relative phase when the relative phases of the cam shaft 10 and the inner rotor 20 relative to the outer rotor 30 are synchronized with each other at a predetermined phase. In order to feed/discharge work oil through the advanced angle passageway 12 to/from advanced angle chambers R1 sectioned by the three vanes 60, 61, 62, passageways 23 are provided for establishing communication between the advanced angle passageway 12 and each advanced angle chamber R1. An annular groove 21 is formed in one terminal face opposed to the leading end face of the cam shaft 10 and is communicated to the retarded angle passageway 11. Three passageways 22 extend from the annular groove 21 toward the other terminal. In order to feed/discharge work oil through the retarded angle passageway 11 to/from retarded angle chambers R2 sectioned by the three vanes 60, 61, 62, passageways 26 are provided for establishing communication between each passageway 22 and each retarded angle chamber R2.

The retracting hole 24 consists of a large diameter (inner diameter) portion located on the front plate 40 side and an intermediate diameter portion located on the rear plate 50 side and having a slightly smaller inner diameter than the large diameter portion. In the large diameter portion, there is formed a passageway 24*a* communicated to the advanced angle chamber R1; and in the intermediate diameter portion, there is formed a passageway 24*b* communicated to the retarded angle chamber R2.

The lock pin 81 is assembled to be axially slidable within the retracting hole 24 and this pin 81 consists of a large diameter portion having a substantially equal diameter to the large diameter portion of the retracting hole 24, an intermediate diameter portion having a substantially equal diameter to the intermediate diameter portion of the retracting hole 24 and a small diameter portion having slightly smaller diameter than the intermediate diameter portion. Inside the large diameter portion, there is mounted a spring 82 for urging the lock pin 81 toward the rear plate 50. The small diameter portion of the pin 81 is configured to engage at a predetermined phase into a receiving hole 29 formed axially in a face of the rear plate 50 which slides against the inner rotor 20. Further, a stepped portion formed between the large diameter portion and the intermediate diameter portion of the lock pin 81 corresponds to a first pressure receiving face 81*a* for receiving oil pressure from the advanced angle chamber R1. A stepped portion formed between the intermediate diameter portion and the small diameter portion corresponds to a second pressure receiving face 81*b* for receiving oil pressure from the retarded angle chamber R2.

Further, in the instant embodiment, in the outer periphery of the vane 60, an engaging groove 28 of the relative rotation restricting mechanism 90 is formed along the peripheral direction. In operation, when the relative phases of the cam shaft 10 and the inner rotor 20 relative to the outer rotor 30 are synchronized with each other in a predetermined range, the leading end of the restricting key 91 to be detailed later engages in this engaging groove 28

The outer rotor 30 is assembled to the outer peripheral portion of the inner rotor 20 to be rotatable relative thereto over a predetermined range. And, to the opposed sides of the outer rotor 30, the front plate 40 and the rear plate 50 are joined respectively and these members are connected together by means of an unillustrated connecting bolt extending through a through hole 32. In the inner peripheral portion of the outer rotor 30, there are formed three projections 31 spaced apart from each other with a predetermined peripheral pitch, with the projections 31 projecting radially inward. As the inner peripheral faces of these projections 31 slidably contact the outer peripheral face of the inner rotor 20, the outer rotor 30 is rotatably supported to the inner rotor 20. On the outer side of the vane 60, there is formed an accommodating groove 35 along the radial direction for accommodating the restricting key 91 of the relative rotation restricting mechanism 90.

The three vanes 60, 61, 62 divide fluid pressure chambers R0 formed between the respective projections 31 of the outer rotor 30, the inner rotor 20, the front plate 40 and the rear plate 50, into two kinds of chambers, i.e. the advanced angle chambers R1 and the retarded angle chambers R2. As the one vane 60 comes into contact with stopper portions 31*a*, 31*b* formed in mutually opposed peripheral end faces of the pair of projections 31 formed in the outer rotor 30, the phase (relative rotation amount) adjusted by the inventive valve timing control apparatus is restricted.

The restricting key 91 is assembled to be radially slidable into the accommodating groove 35 and is urged toward the inner rotor 20 by the spring 92. The urging force of this spring 92 is set to be substantially equal to the centrifugal force generated in the restricting key 91 at a predetermined rotational speed.

In the instant embodiment, as described hereinbefore, when the relative phases of the cam shaft 10 and the inner rotor 20 relative to the outer rotor 30 are at a neutral position within each fluid pressure chamber R0 (i.e. at the time of phase where the respective vanes do not contact either the advanced angle side peripheral end face or retarded angle side peripheral end face of the respective projection 31), the retracting hole 24 and the receiving hole 29 come into synchronism (positional registry) with each other, thereby to allow the small diameter portion of the lock pin 81 to engage into the receiving hole 29. Upon establishment of this predetermined relative phase, the opening/closing time of the unillustrated intake valve is set at a timing allowing startup of the internal combustion engine (the opening/closing timing of the intake valve is slightly advanced (intermediate advanced angle) timing). Further, in this embodiment, the positions of the engaging groove 28 and the accommodating groove 35 are set such that the leading end of the restricting key 91 may engage into the engaging groove 28 when the phase is within a relative phase range from the above-described predetermined relative phase to the most advanced angle state.

Next, the operation of the valve timing control apparatus according to the instant embodiment having the above-described construction will be explained.

At the time of startup of the internal combustion engine, there is no electric power supply from the controller ECU to the solenoid 102 of the control valve 100. Therefore, work oil discharged from the oil pump P driven by the internal combustion engine is fed to the advanced angle chamber R1 through the supply port 101*c*, the connection port 101*b*, the connecting passageway 72, the passageway 13, the advanced angle passageway 12 and the passageway 23. However, since the passageway 24*a* communicating the advanced angle chamber R1 to the retracting hole 24 is being blocked by the large diameter portion of the lock pin 81, no oil pressure is applied to the first pressure receiving face 81*a* of the lock pin 81, so that the small diameter portion of the lock pin 81 is held as being engaged into the receiving hole 29 of the rear plate.

Figure 3:
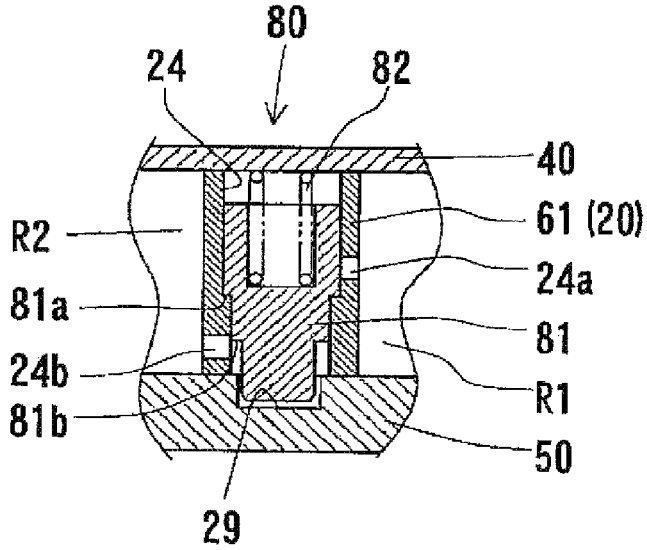
FIG. 3 is a section in FIG. 2.
Figure 4:
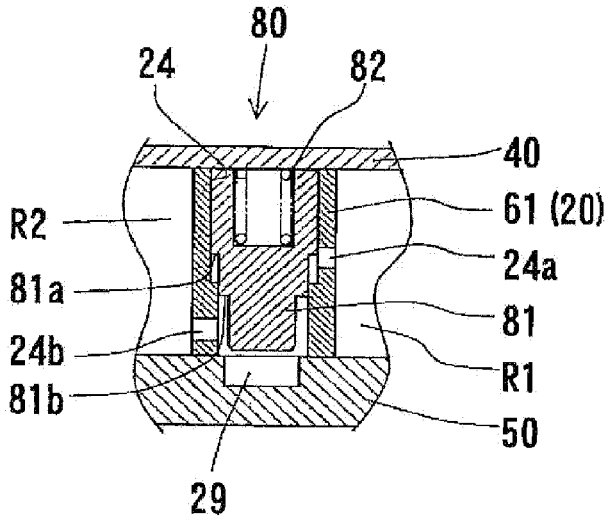
FIG. 4 is a view taken along III-III in FIG. 2 showing a lock released condition.

Upon startup of the internal combustion engine, the restricting key 91 of the relative rotation restricting mechanism 90 is accommodated into the accommodating groove 35 by the centrifugal force, and the foregoing engagement between the key and the engaging groove 28 is now released. Subsequently, upon electric power supply from the controller ECU to the solenoid 102 of the control valve 100, the spool 101 is moved to the left side against the spring 103, thus realizing the condition illustrated in FIG. 1, so that the work oil discharged from the oil pump P is now fed to the retarded angle chamber R2 through the supply port 101*c*, the connection port 101*a*, the connecting passageway 71, the retarded angle passageway 11, the passageway 22 and the passageway 26. Now, the passageway 24*b* communicating the retarded angle chamber R2 to the retracting hole 24 is opened to the small diameter portion of the lock pin 81 as illustrated in FIG. 3. Therefore, the work oil pressure effective in the retarded angle chamber R2 is applied to the second pressure receiving face 81*b* of the lock pin 81 via the passageway 24*b*. As a result, as shown in FIG. 4, the lock pin 81 is moved within the retracting hole 24 toward the front plate 40, and the foregoing engagement between the small diameter portion of the lock pin 81 with the receiving hole 29 of the rear plate 50 is now released. Under this condition (i.e. lock released state), the passageway 24*a* of the large diameter portion of the restricting hole 24 communicated to the advanced angle chamber R1 is opened up.

Under the lock released state described above, at the time of advanced angle operation, the oil pressure of the advanced angle chamber R1 is applied via the passageway 24*a* to the first pressure receiving face 81*a*; and at the time of retarded angle operation, the oil pressure of the retarded angle chamber R2 is applied through the passageway 24*b* to the second pressure receiving face 81*b*. Namely, the lock released state can be effectively maintained with either the oil pressure, i.e. the advance angle oil pressure or the retarded angle oil pressure.

Figure 5:
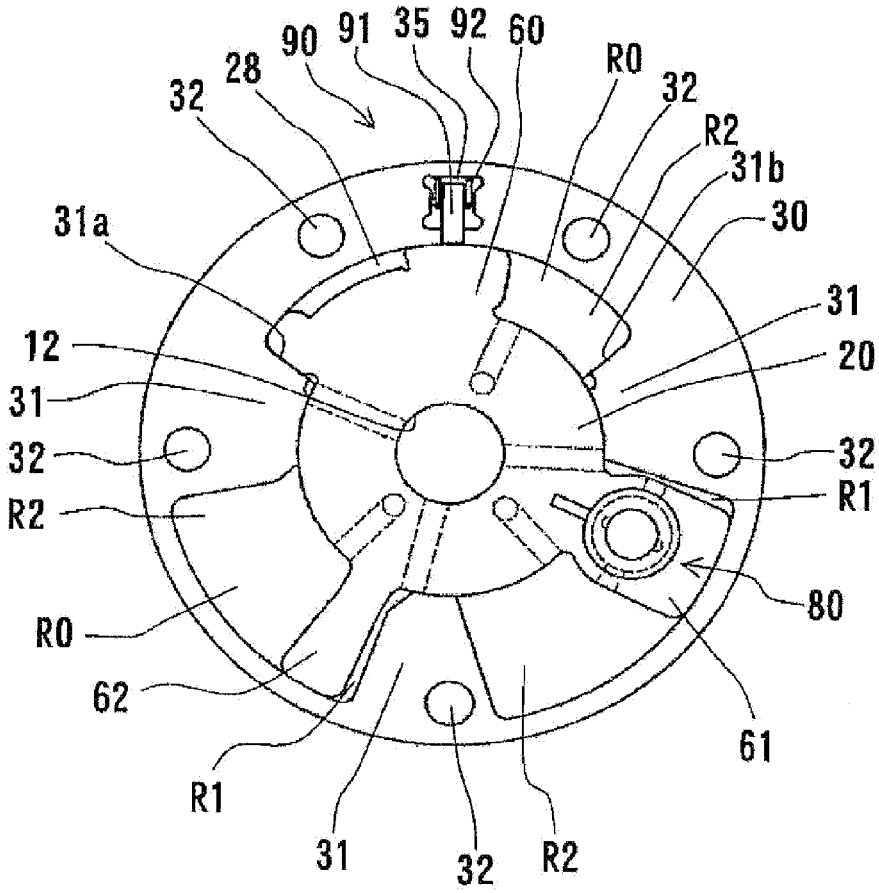
FIG. 5 is a view taken along II-II in FIG. 1 showing a most retarded angle state.
Figure 6:
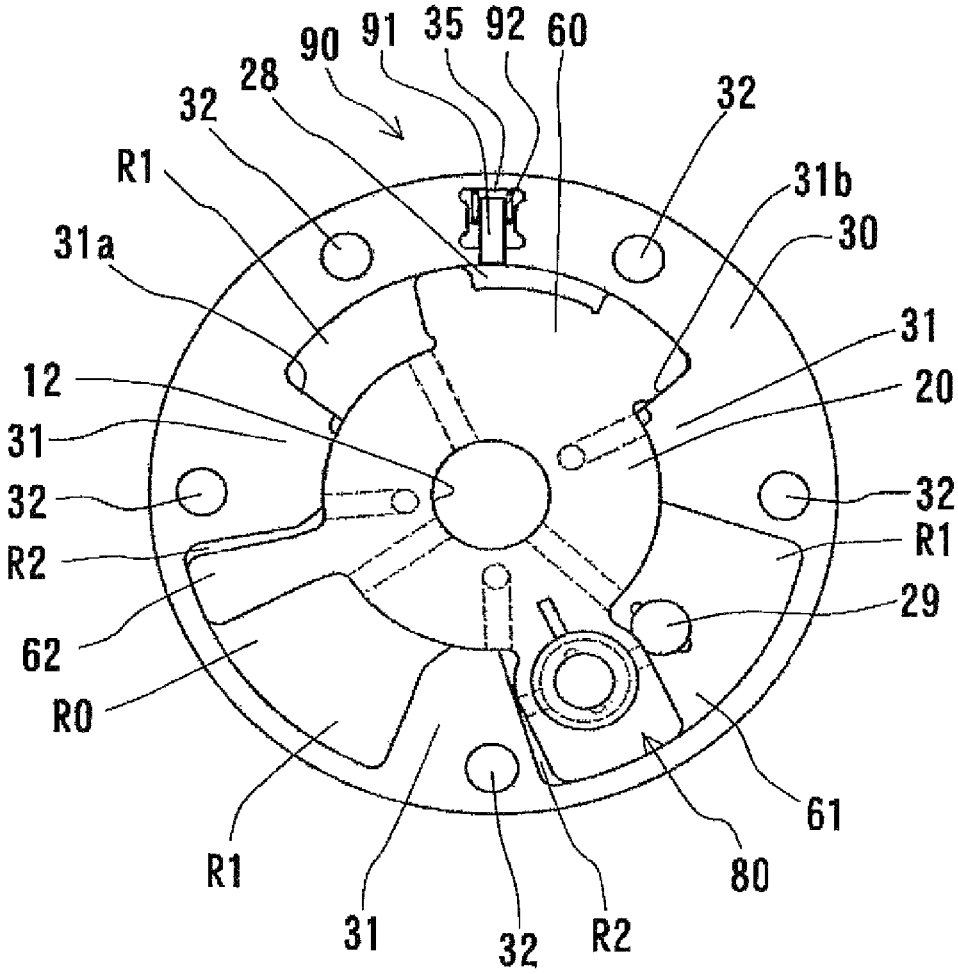
FIG. 6 is a view taken along II-II in FIG. 1 showing a most advanced angle state.

By increasing the duty ratio of the electric current supplied to the solenoid 102 of the control valve 100 depending on the operational condition of the internal combustion engine, the work oil is fed to the respective retarded angle chamber R2 via the retarded angle passageway 11 and the passageway 26 and also the work oil is discharged from the respective advanced angle chamber R1 via the passage 23, the advanced angle passageway 12 and the control valve 100, etc. Whereby, the inner rotor 20 and the respective vanes 60, 61, 62 are rotated to the retarded angle side (counterclockwise in FIG. 2) relative to the outer rotor 30, the two plates 40, 50, etc. And, the amount of this relative rotation (maximum retarded angle amount) is restricted as the one vane 60 comes into contact with the stopper portion 31*a* formed at the advanced angle side peripheral end face of the projection 31 as shown in FIG. 5. Conversely, by decreasing the duty ratio of the electric current supplied to the solenoid 102 of the control valve 100, the work oil is fed to the respective advanced angle chamber R1 through the advanced angle passageway 13 and the passageway 23 and also work oil is discharged from the respective retarded angle chamber R2 through the respective passages 26, 22, the retarded angle passageway 11, the control valve 100, etc. Whereby, the inner rotor 20 and the respective vanes 60, 61, 62 are rotated to the advanced angle side (clockwise in FIG. 2) relative to the outer rotor 30, the two plates 40, 50, etc. And, the amount of this relative rotation (maximum advanced angle amount) is restricted as the one vane 60 comes into contact with the stopper portion 31*b* formed at the retarded angle side peripheral end face of the projection 31 as shown in FIG. 6. Incidentally, during this phase change restriction, as described above, by either the oil pressure of the advanced angle oil pressure or the retarded angle oil pressure, the locking by the lock pin 81 is released. Further, the restricting key 91 is urged in the radially outer direction by the centrifugal force, thus being moved against the spring 92, so that the leading end of the restricting key 91 is moved out of the engaging groove 28 to be retracted into the accommodating groove 35, thus releasing the engagement by the restricting key 91.

Next, the operation at the time of stopping of the internal combustion engine will be explained. During an idling condition prior to stopping of the internal combustion engine, the centrifugal force applied to the restricting key 91 is decreased, so that its leading end comes into engagement with the engaging groove 28, thus restricting relative rotation to a retarded angle phase. Under this condition, electric power is supplied to the solenoid 102 of the control valve 100 to feed the work oil to the retarded angle chamber R2, thus being shifted to the locking phase.

Upon stopping of the internal combustion engine, the driving of the oil pump P is stopped, thereby to stop feeding of the work oil to the fluid pressure chamber R0 and also power supply to the control valve 100 is stopped. With this, the pressing force due to the advanced angle oil pressure inside the advanced angle chamber R1 and the pressing force due to the retarded angle oil pressure inside the retarded angle chamber R2 are no longer applied to the vanes 60, 61, 62, so that no pressure is supplied to the first pressure receiving face or the second pressure receiving face of the lock pin 81. Consequently, under the urging force of the spring 82, the small diameter portion of the lock pin 81 is brought into engagement within the receiving hole 29, thereby to hold (lock) the relative phase between the inner rotor 20 and the outer rotor 30.

As described above, according to the present invention, in response to an electric signal from the controller ECU, the lock pin 81 has its relative phase holding state released only by the fluid pressure of the retarded angle passageway 11 to whichever the control valve 100 starts feeding of work oil. Therefore, there occurs no inadvertent erroneous operation of the lock pin 81 by the advanced angle oil pressure supplied from the oil pump P which starts its operation simultaneously with startup of the internal combustion engine. Consequently, a predetermined intermediate phase can be maintained in a reliable manner with such simple construction as above.

Incidentally, in the foregoing embodiment, the present invention is applied to a valve timing control apparatus configured such that work oil is fed to the advanced angle chamber R1 when no electric power is supplied to the control valve 100 and work oil is fed to the retarded angle chamber R2 when electric power is supplied to the control valve 100. However, the present invention can be applied also to a valve timing control apparatus configured such that work oil is fed to the advanced angle chamber R1 when electric power is supplied to the control valve 100 and work oil is fed to the retarded angle chamber R2 when no electric power is supplied to the control valve 100.

Next, another embodiment of the present invention will be described. Meanwhile, this further embodiment differs from the foregoing embodiment only in that the pressure receiving areas of the first pressure receiving face 81*a* and the second pressure receiving face 81*b* are made different from each other, the further embodiment being no different from the foregoing embodiment in the other respects. Therefore, in the following, reference will be made again to FIGS. 1 through 6.

The first pressure receiving face 81*a* and the second pressure receiving face 81*b* are configured to differ in the pressure receiving areas thereof from each other.

Further, an arrangement is provided such that the engagement between the small diameter portion of the lock pin 81 and the receiving hole 29 of the rear plate 50 is released in response to application of work oil pressure to the second pressure receiving face 81*b*.

In the above, the second pressure receiving face 81*b* is set larger than the first pressure receiving face 81*a*. Specifically, the pressing force applied by the fluid fed from the oil pump P ("the fluid feeding device") at the time of an idling operation of the internal combustion engine to the first pressure receiving face 81*a* in the direction against the urging force of the spring 82 ("the urging member") is set smaller than this urging force of the spring 82. Also, the pressing force applied by the fluid fed from the oil pump P at the time of an idling operation of the internal combustion engine to the second pressure receiving face 81*b* in the direction against the urging force of the spring 82 ("the urging member") is set greater than this urging force of the spring 82.

With the above-described setting of the pressure receiving areas of the first pressure receiving face 81*a* and the second pressure receiving face 81*b*, at the time of an idling operation of the internal combustion engine, even when an amount of work oil is being fed from the oil pump P to the lock pin 81 ("the restricting member"), the relative phase between the inner rotor 20 ("inner peripheral member") and the outer rotor 30 ("outer peripheral member") can still be effectively held by this lock pin 81. Therefore, unlike the case of the relative phase between the inner rotor 20 and the outer rotor 30 being held by the lock pin 81 after stopping of the internal combustion engine, even if the lock pin 81 has once failed to hold the relative phase, an operation for holding the relative phase by the lock pin 81 can be effected again.

For providing appropriate control in the case of failure to hold the relative phase by the lock pin 81, first, the relative rotational phase of the inner rotor 20 relative to the outer rotor 30 will be shifted to a predetermined intermediate phase. In this, if the movement to the predetermined intermediate phase was effected by feeding of work oil to the advanced angle oil chamber R1, the small diameter portion of the lock pin 81 will directly be brought into engagement into the receiving hole 29 of the rear plate 50. On the other hand, if the above movement to the predetermined intermediate phase was effected by feeding of work oil to the retarded angle oil chamber R2, the work oil has acted on the second pressure receiving face 81*b* thus realizing the retracted state, so that the small diameter portion of the lock pin 81 will not engage into the receiving hole 29 of the rear plate 50. Under this condition, the control valve 100 ("the fluid control valve") will effect a controlling operation for switching over the work oil pressure to be supplied from the retarded angle chamber R2 to the advanced angle chamber R1, whereby the work oil pressure will now be applied to the first pressure receiving face 81*a*. However, because the pressing force applied to the first pressure receiving face 81*a* is overwhelmed by (i.e. smaller than) the urging force of the spring 82, the small diameter portion of the lock pin 81 will be brought into engagement into the receiving hole 29 of the rear plate 50.

Therefore, even under a "failed condition" wherein the holding of relative phase by the lock pin 81 being inadvertently disabled, the relative phase can be effectively held by the lock pin 81 in a reliable manner.

Further, conversely, if it is desired to release the engagement between the small diameter portion of the lock pin 81 and the receiving hole 29 of the rear plate 50, the engagement of the lock pin 81 can be released simply by applying the work oil pressure to the second pressure receiving face 81*b*. Therefore, even with the above-described arrangement of the first pressure receiving face 81*a* for avoiding the failed condition of the holding of the relative phase by the lock pin 81 being disabled, it is still possible to avoid inadvertent disablement of releasing the relative phase holding by the lock pin 81.

In the foregoing embodiment, the restricting key 91 is configured to project/retract from the outer rotor 30 relative to the vane 60. However, the present invention is not limited thereto. Although not shown, it is also possible to configure the restricting key to project/retract from the projection 31 relative to the inner rotor 20.

INDUSTRIAL APPLICABILITY

The present invention is applicable to a valve timing control apparatus for controlling opening and closing timings of an intake valve and an exhaust valve of an internal combustion engine.

DESCRIPTION OF REFERENCE MARKS/NUMERALS

10 cam shaft
11 retarded angle passageway ("second fluid passageway")
12 advanced angle passageway ("first fluid passageway")
20 inner rotor ("inner peripheral member")
24 retracting hole ("accommodating hole")
29 receiving hole
30 outer rotor ("outer peripheral member")
35 accommodating groove
40 front plate ("outer peripheral member")
50 rear plate ("outer peripheral member")
60, 61, 62 vanes
70 cylinder head
80 lock mechanism ("phase holding mechanism")
81 lock pin ("restricting member")
81*a* first pressure receiving face
81*b* second pressure receiving face
82 spring ("urging member")
100 control valve ("fluid control valve")
P oil pump ("fluid feeding device")
R0 fluid pressure chamber
R1 advanced angle chamber
R2 retarded angle chamber

The invention claimed is:

1. A valve timing control apparatus comprising:

an inner peripheral member rotatable in unison with a valve opening/closing cam shaft rotatably assembled to a cylinder head of an internal combustion engine;

a vane rotatable in unison with said inner peripheral member;

an outer peripheral member rotatable relative to said inner peripheral member;

a plurality of fluid pressure chambers disposed between said inner peripheral member and said outer peripheral member and divided by said vane into an advanced angle chamber and a retarded angle chamber;

a first fluid passageway for feeding/discharging fluid to/from said advanced angle chamber;

a second fluid passageway for feeding/discharging fluid to/from said retarded angle chamber;

a phase holding mechanism for holding a relative phase between said inner peripheral member and said outer peripheral member to a predetermined phase between a most advanced angle phase and a most retarded angle phase, said phase holding mechanism including a restricting member, an accommodating hole for slidably accommodating said restricting member, and a receiving hole for receiving said restricting member, said phase holding mechanism being configured to hold said relative phase as said restricting member is received and engaged into said receiving hole;

a pump feeding fluid to said advanced angle chamber or said retarded angle chamber through said first fluid passageway or said second fluid passageway; and a fluid control valve for switching over the passage for the fluid discharged from said pump to either said first fluid passageway or said second fluid passageway and controlling the feeding amount of said fluid;

wherein said restricting member having a large diameter portion, an intermediate diameter portion having a smaller diameter than said large diameter portion and formed on the receiving hole side portion of said large diameter portion, and a small diameter portion having a smaller diameter than said intermediate diameter portion and formed on the receiving hole side portion of said intermediate diameter portion, said small diameter portion being engageable within said receiving hole, a first pressure receiving face being a stepped face between said large diameter portion and said intermediate diameter portion and a second pressure receiving face being a stepped face between said intermediate diameter portion and said small diameter portion;

said phase holding mechanism further includes a first inlet communicated to one of said advanced angle chamber and said retarded angle chamber, said first inlet being configured so that the fluid from the one of said advanced angle chamber and said retarded angle chamber enters through said first inlet and applies fluid pressure of one of said advanced angle chamber and said retarded angle chamber to said first pressure receiving face and a second inlet communicated to the other of said advanced angle chamber and said retarded angle chamber, said second inlet being configured so that the fluid from the other of said advanced angle chamber and said retarded angle chamber enters through said second inlet and applies fluid pressure of the other of said advanced angle chamber and said retarded angle chamber to said second pressure receiving face;

when said relative phase is held to said predetermined phase, said first inlet is blocked by said large diameter portion;

the holding state of said relative phase is released as the fluid pressure of the other of said advanced angle chamber and said retarded angle chamber to whichever said fluid control valve starts feeding of the fluid entering through said second inlet applies fluid pressure to said second pressure receiving face; and after releasing of said holding state of said relative phase holding mechanism, the releasing state of said relative phase holding mechanism is maintained by at least one of the application to said first pressure receiving face of the fluid pressure of said advanced angle chamber and the application to said second pressure receiving face of the fluid pressure of said retarded angle chamber.

2. The valve timing control apparatus according to claim 1, wherein said phase holding mechanism includes said restricting member for restricting said relative phase, said accommodating hole provided in said inner peripheral member for slidably accommodating said restricting member, said receiving hole provided in said outer peripheral member for receiving the leading end of said restricting member and an urging member for urging said restricting member in the direction to said outer peripheral member; and in response to switchover of the fluid feeding from said pump from either one of said advanced angle chamber and said retarded angle chamber to the other of said advanced angle chamber and said retarded angle chamber, the other of the fluid pressure of said advanced angle chamber and the fluid pressure of said retarded angle chamber is applied to said second pressure receiving face, thereby to release the holding state of said phase holding mechanism.

3. The valve timing control apparatus according to claim 1, wherein said first pressure receiving face and said second pressure receiving face are configured to have different pressure receiving areas from each other.

4. The valve timing control apparatus according to claim 3, wherein said pump is rotatably driven by receiving a rotational force of a crank shaft of the internal combustion engine; and said restricting member applying a pressing force against the urging force of said urging member, the pressing force resulting from, during an idling operation of the internal combustion engine, application of the fluid fed from said pump to one of whichever of said first pressure receiving face and said second pressure receiving face having the smaller pressure receiving area than the other, the pressing force being smaller than the urging force of said urging member.

5. The valve timing control apparatus according to claim 4, wherein said restricting member applies a pressing force against the urging force of said urging member, the pressing force resulting from, during an idling operation of the internal combustion engine, application of the fluid fed from said pump to one of whichever of said first pressure receiving face and said second pressure receiving face having the larger pressure receiving area than the other, the pressing force being larger than the urging force of said urging member.

6. The valve timing control apparatus according to claim 3, wherein in response to switchover of the fluid feeding from said pump from either one of said advanced angle chamber and said retarded angle chamber to the other of said advanced angle chamber and said retarded angle chamber, the fluid pressure of the other of said advanced angle chamber and said retarded angle chamber is applied to said second pressure receiving face, thereby to release the holding state of said phase holding mechanism.

* * * * *